United States Patent [19]

Kawada et al.

[11] 4,107,578

[45] Aug. 15, 1978

[54] GAS DISCHARGE PANEL DRIVE SYSTEM

[75] Inventors: Toyoshi Kawada; Shizuo Andoh; Kazuo Yoshikawa, all of Kobe, Japan

[73] Assignee: Fujitsu Limited, Kawasaki, Japan

[21] Appl. No.: 790,094

[22] Filed: Apr. 22, 1977

[30] Foreign Application Priority Data

May 10, 1976 [JP] Japan ..... 51/53589

[51] Int. Cl.[2] ..... H05B 37/00; H05B 39/00; H05B 41/00

[52] U.S. Cl. ..... 315/169 TV; 340/324 M

[58] Field of Search ..... 315/169 TV, 169 R; 340/324 M, 166 R

[56] References Cited

U.S. PATENT DOCUMENTS 3,938,135 2/1976 DeJule et al. ..... 340/324 M

*Primary Examiner*—Alfred E. Smith
*Assistant Examiner*—Robert E. Wise
*Attorney, Agent, or Firm*—Staas & Halsey

[57] ABSTRACT

A drive system for an alternating current (AC) driven type gas discharge panel in which either one of the electrode pitches of X and Y electrodes is made smaller than the other. A positive pulse voltage is applied to the electrodes of the smaller electrode pitch and a negative pulse voltage is applied to the electrodes of the larger electrode pitch, thereby to write information in a selected discharge point. The AC driven type gas discharge panel of an electrode arrangement of an asymmetrical electrode pitch is driven with a maximum write margin which does not cause half select misfire.

10 Claims, 8 Drawing Figures

GAS DISCHARGE PANEL DRIVE SYSTEM

BACKGROUND OF THE INVENTION

1. Field of the Invention

This invention relates to a gas discharge panel drive system, and more particularly to a drive system for an alternating AC current driven type gas discharge panel which is capable of high resolution display.

2. Description of the Prior Art

A gas discharge panel, in which electrodes covered with dielectric layers are disposed opposite to each other across a space having sealed therein a discharge gas, is known under the name of a plasma display panel. In such a gas discharge panel heretofore employed, X-direction electrodes (hereinafter referred to as X electrodes) $xi$ ($i$ = 1, 2, 3, . . .) and Y-direction electrodes (hereinafter referred to as the Y electrodes) $yj$ ($J$ = 1, 2, 3, . . .) are disposed to intersect each other at right angles, and electrode pitches px and py are equal to each other, as shown, for example, in FIG. 1, which is a diagrammatic representation of the electrode arrangement in a conventional or "prior art" gas discharge panel. A sustain pulse is applied to each electrode and, in the case of a write operation, a write pulse is applied to each of selected ones of the X and Y electrodes. Letting a firing voltage and a minimum sustain pulse voltage (of a discharge point $C_{ij}$ at the intersection of the electrodes $xi$ and $yj$) be represented with $V_f$ and $V_{sm}$, respectively, a pulse voltage $V_s$ is selected to bear a relationship, $V_{sm} < V_s < V_f$, and a write pulse voltage $V_w$ to the selected discharge point is selected to have a relationship, $V_f < V_w$.

FIG. 2 shows an example of a driving waveform. Reference characters $V_{xa}$ and $V_{ya}$ indicate voltages applied to selected ones of the X and Y electrodes, respectively; $V_{xb}$ and $B_{yb}$ designate voltages applied to unselected X and Y electrodes, respectively; $V_a$ identifies a voltage applid to a selected discharge point; PS denotes a sustain pulse of the voltage $V_s$; PWX represents a positive half selection write pulse of a voltage $V_{xw}$; PWY shows a negative half selection write pulse of a voltage $V_{yw}$; and PW refers to a write pulse of a voltage $V_{xw} + V_{yw} = V_w$. For example, in the case of writing information in a discharge point C33 at the intersection of the electrodes $x3$ and $y3$ in the panel shown in FIG. 1, a pulse train identified by the waveform $V_{xa}$ and a pulse train indicated by the waveform $V_{ya}$ are applied to the electrodes $x3$ and $y3$, respectively, and pulse trains identified by waveforms $V_{xb}$ and $V_{yb}$, respectively, are applied to the other unselected electrodes, by which the write pulse of the composite write pulse voltage $V_w = V_{xw} + V_{yw}$ is applied to the discharge point C33 at the timing of write. Since the write pulse voltage $V_w$ is higher than the firing voltage $V_f$, a discharge spot is produced at the discharge point C33.

FIG. 3 is a graph showing the write characteristic of the conventional gas discharge panel described above, the ordinate representing the sustain pulse voltage $V_s$ and the abscissa representing the composite write pulse voltage $V_w$, and the hatched range being a normal operation region. For example, where the sustain pulse voltage $V_s$ has a value $V_{sb}$ the lowest composite write pulse voltage is $V_{wl}$, above which write is possible. As the voltage $V_w$ gradually rises, the intensity of a write discharge due to a charge coupling effect increases, resulting in an erroneous discharge or misfire of the neighboring discharge points owing to half selection. The range in which such misfire is not caused is defined as the write operation margin, and the composite write pulse voltage $V_w$ must be set in such a range.

The present inventors have discovered polarity dependency of the write pulse in the phenomenon of causing such misfire at the neighboring discharge points. That is, when the composite write pulse voltage of the positive and negative write pulses PWX and PWY (FIG. 2) applied to the electrodes $x3$ and $y3$, respectively, is $V_{whl}$, misfire is produced at the neighboring discharge points C32 and C34 along the electrode $x3$ supplied with the positive half selection write pulse PWX, but no misfire is caused at the neighboring discharge points C23 and C43 along the electrode $y3$ supplied with the negative half selection write pulse PWY, even if the voltages $V_{xw}$ and $V_{yw}$ of the half selection write pulses PWX and PWY, respectively, are equal to each other. When the composite write pulse voltage further increases to a value $V_{wh2}$, misfire is also produced at the abovesaid discharge points C23 and C43. That is, the neighboring discharge points in the X- and Y-directions, in which misfire is caused by half selection, differ with the polarity of the write pulse.

SUMMARY OF THE INVENTION

An object of this invention is to provide an AC driven type gas discharge panel drive system which is capable of high resolution display.

Another object of this invention is to provide an AC driven type gas discharge panel drive system which is capable of high resolution display and which has a simple construction, utilizing the fact that the generation of misfire at the neighboring discharge points is dependent upon the polarity of the write pulse applied to a selected discharge point.

Briefly stated, in accordance with this invention, the electrode pitch of either one of the X and Y electrodes is selected larger than the electrode pitch of the other, and a write voltage is applied to the selected discharge point by applying a positive write pulse to the electrode of the smaller electrode pitch and a negative write pulse to the electrode of the larger electrode pitch.

DESCRIPTION OF THE PREFERRED EMBODIMENTS

Figure 2:
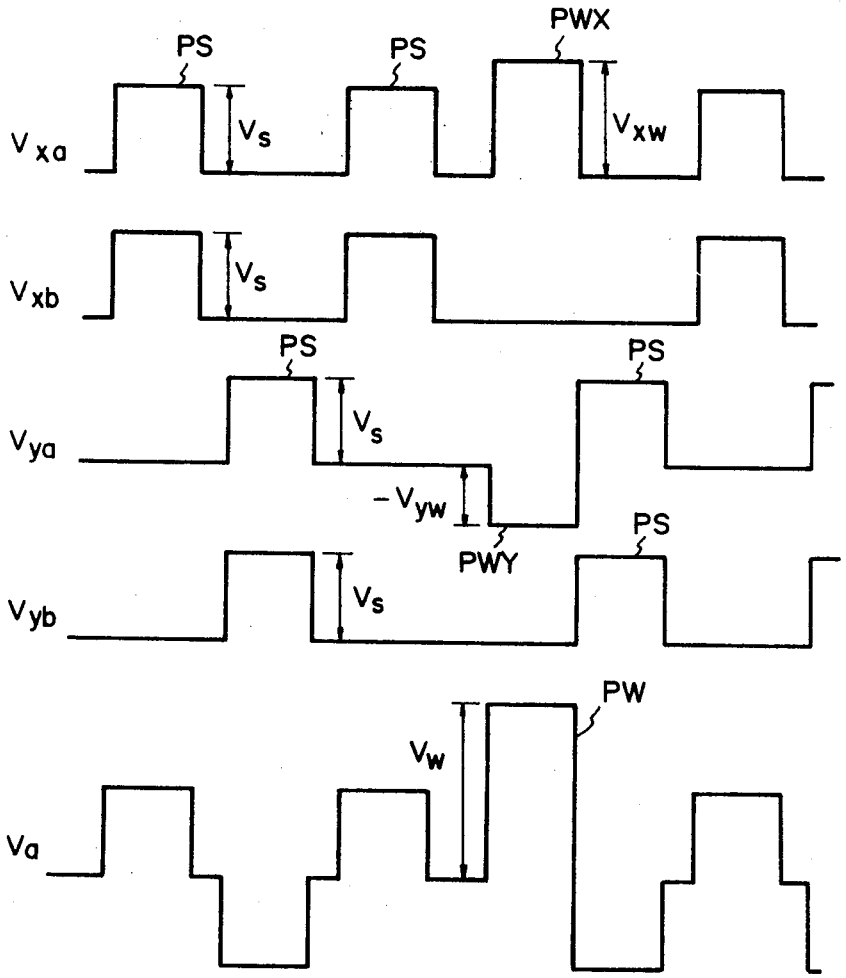
FIG. 2 PRIOR ART
FIG. 2 is a waveform diagram showing driving waveforms used for the conventional gas discharge panel.
Figure 4:
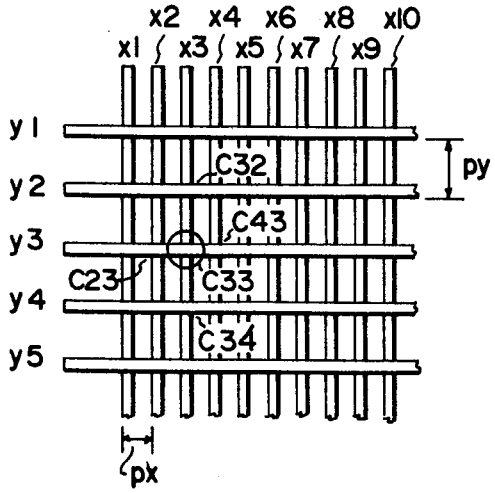
FIG. 4 is a diagram explanatory of the electrode arrangement in a gas discharge panel embodying this invention.

FIG. 4 is explanatory of the electrode arrangement adopted in an embodiment of this invention, in which the pitch $px$ of the electrodes $xi$ ($i = 1, 2, \ldots, 10$) is selected smaller than the pitch py of the electrodes $yj$ ($j = 1, 2, \ldots, 5$). In this case, the driving waveforms may be such, for instance, as shown in FIG. 2, and the write pulse PWX to the electrode $xi$ is positive and the write pulse to the electrode $yj$ is negative. That is, the electrode pitch of the electrodes supplied with the positive write pulse is selected smaller than the electrode pitch of the electrodes supplid with the negative write pulse.

Figure 5:
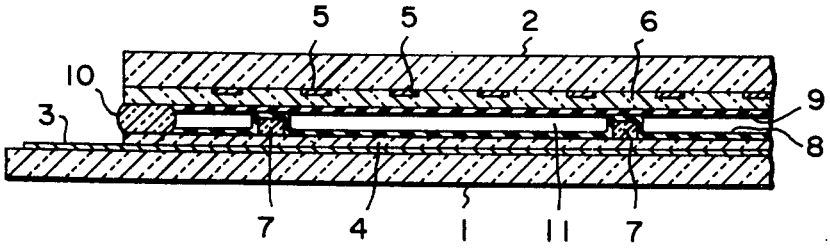
FIG. 5 is a sectional view illustrating the principal part of the gas discharge panel of this invention.

FIG. 5 shows in section the principal part of the gas discharge panel, which is constructed to include a pair of substrates 1 and 2, as of glass, disposed opposite to each other. The substrate 1 carries on its inside a plurality of Y electrodes 3 arranged in a horizontal direction and covered with a dielectric layer 4, as of a low-melting-point glass. The other substrate 2 also carries on its inside X electrodes 5 disposed in a direction to intersect the abovesaid Y electrodes at right angles thereto and covered with a dielectric layer 6 as of a low-melting-point glass.

Prior to the assembly of such a gas discharge panel, glass spacers 7 are fixed to the dielectric layer 4 by an adhesive which is decomposed by heating, after firing of the dielectric layer 4. Then, the assembly including the substrate 1 is heated. By this heat treatment, the adhesive is decomposed or evaporated and, at the same time, the glass spacers 7 are fused with the dielectric layer 4 of the low-melting-point glass. Thereafter, a protective layer 8 of magnesium oxide (MgO) is formed on the surface of the dielectric layer 4 including the glass spacers 7. A similar protective layer 9 is also formed on the other dielectric layer 6.

The two substrates thus prepared are disposed opposite to each other, with the X and Y electrodes 5 and 3 crossing each other, and the periphery of the assembly is sealed with a sealing member 10. Next, a space 11 defined by the spacers 7 is evacuated, and then a mixed gas for discharge is sealed into the space 11, thus providing a gas discharge panel.

Figure 1:
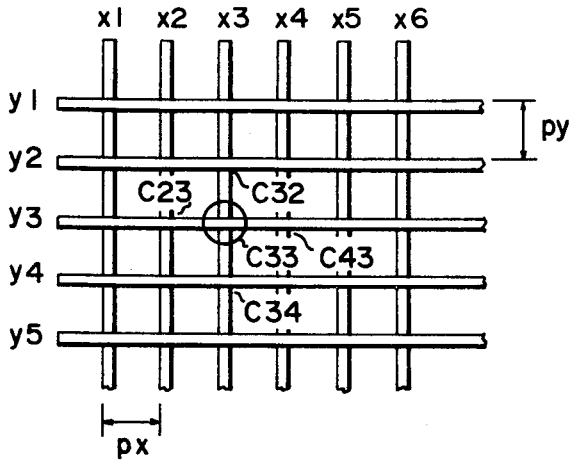
FIG. 1 PRIOR ART
FIG. 1 is a diagram explanatory of the electrode arrangement in a conventional gas discharge panel.
Figure 3:
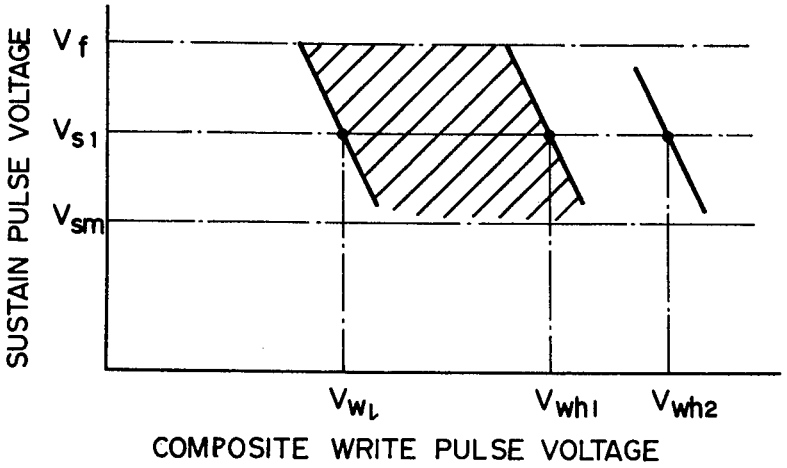
FIG. 3 PRIOR ART
FIG. 3 is a graph showing the write operation characteristic of the conventional gas discharge panel.
Figure 6:
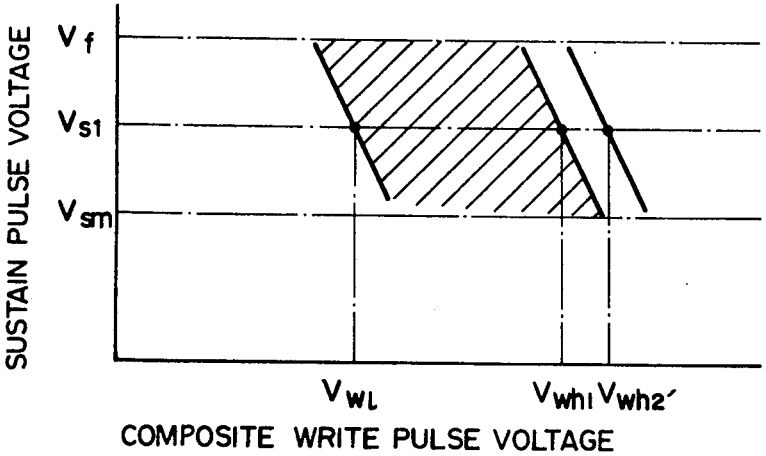
FIG. 6 is a graph showing the write operation characteristic of the gas discharge panel of this invention.

The operation characteristic of such a gas discharge panel is shown in FIG. 6, in which the hatched range is the normal operation region of the panel, which is substantially similar to the operation region of the conventional discharge panel as such operation region is depicted in FIG. 3. In the present invention, however, referring to FIGS. 4 and 6 the pitch of the electrodes $xi$ is reduced as compared with that of the electrodes $yj$ as described above. As a result of this, for instance, in the case of writing information in the discharge point C33, when the composite write pulse voltage is $V_{whh}$, a faulty discharge is produced at the neighboring discharge points C32 and C34 along the electrode $x3$, and when the abovesaid composite voltage is $V_{wh2}$, a faulty discharge is similarly caused at the neighboring discharge points C23 and C43 along the electrode $y3$. A comparison of the characteristic shown in FIG. 6 with that of FIG. 3 reveals that $V_{wh2} > V_{wh2'}$ and that $V_{whl} < V_{wh2'}$. Consequently, even if the pitch of the electrodes $xi$ is decreased, the normal operation range is not reduced.

Thus, since the decreased pitch of the electrodes $xi$ does not lead to the reduction of the normal operation region, a stable and high resolution display can be provided. The pitch $px$ (FIG. 4) of the electrodes $xi$ may be reduced to about $\frac{1}{2}$ of the pitch py of the other electrodes $yj$. Further, in the case where the pitch of the Y electrodes is smaller than that of the X electrodes, write can be accomplished by applying a negative pulse voltage to the X electrode and a positive pulse voltage to the Y electrode. That is, the present invention utilizes the phenomenon that the coupling effect of the neighboring discharge points in the direction (the X-direction) of the electrodes, supplied with the positive write pulse voltage is larger than in the direction (Y-direction) of the electrodes supplied with the negative write pulse voltage, and the invention achieves the high resolution display by reducing one of the electrode pitches without decreasing the write margin.

Figure 7:
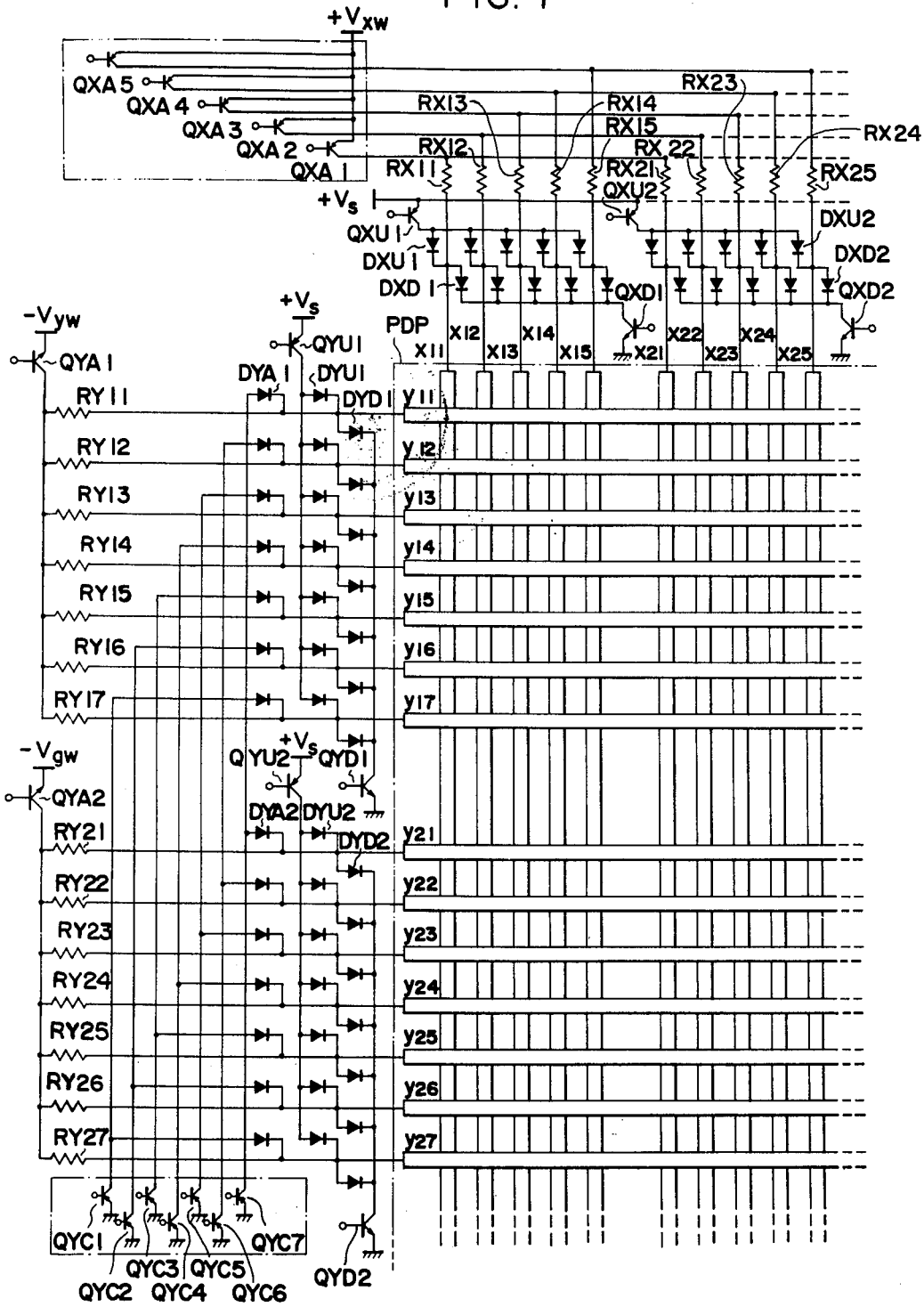
FIG. 7 is a drive circuit for use in the embodiment of this invention.

FIG. 7 illustrates the principal part of the construction of a drive circuit for use in the embodiment of the abovesaid drive system. A gas discharge panel PDP is shown to have a 5 × 7 dot matrix for a character display, and the Y electrode pitch is larger than the X electrode pitch.

Y electrode groups, each composed of seven electrodes $y11$ to $y17$ and $y21$ to $y27$ of large pitch, for defining respective character rows, are connected to pairs of "up sustain" transistors QYU1 and QYU2 and "down sustain" transistors OYD1 and QYD2 through two groups of diode arrays DYU1, DYU2 and DYD1, DYD2, respectively. The electrodes of the respective electrode groups are respectively connected through resistor arrays RY11 to RY17 and RY21 to RY27 to address switching transistors QYA1 and QYA2 connected to a negative power source $-V_{yw}$. Further, corresponding ones of electrodes of the Y electrode groups are respectively connected to address clamping transistors QYC1 to QYC7 through diode arrays DYA1 and DYA2. Thus, the Y electrodes are selectively supplied with the negative write pulse PWY by the address switching transistors and the address clamping transistors of the resistor-diode matrix structure.

On the other hand, X electrode groups, each composed of five electrodes $x11$ to $x15$ and $x21$ to $x25$ of small pitch, for defining respective character columns, are connected to pairs of "up sustain" transistors QXU1 and QXU2 and "down sustain" transistors QXD1 and QXD2 through two groups of diode arrays DXU1, DXU2 and DXD1, DXD2, respectively. Further, corresponding ones of the electrodes of the respective X electrode groups are respectively connected to address switching transistors QXA1 to QXA5 through resistor arrays RX11 to RX15 and RX21 to RX25. The address switching transistors QXA1 to QXA5 are respectively connected to a positive power source $+V_{xw}$ and, by their selective switching operation, the X electrodes of the respective X electrode groups are selectively supplied with the positive write pulse PWX. In this case, the selection of the respective X electrode groups is accomplished by the "down sustain" transistors QXD1 and QXD2 in such a manner that unselected ones of electrodes are clamped at the ground potential. Reference character $+V_3$ indicates a sustain voltage. By the operation of the "up sustain" transistors and "down sustain" transistors on both sides of the X and Y electrode groups, the sustain pulse is applied to each electrode.

In the abovesaid drive circuit, write pulses corresponding to character pattern information are sequentially applied to selected ones of the X electrodes for each character block in the so-called line in a timed manner, by which a desired character can be written for a display. In this case, since the pitch of the X electrodes extending in a vertical direction is smaller than the pitch of the Y electrodes, the displayed character is easy to interpret and, further, driving can be effected with a large operation margin.

Figure 8:
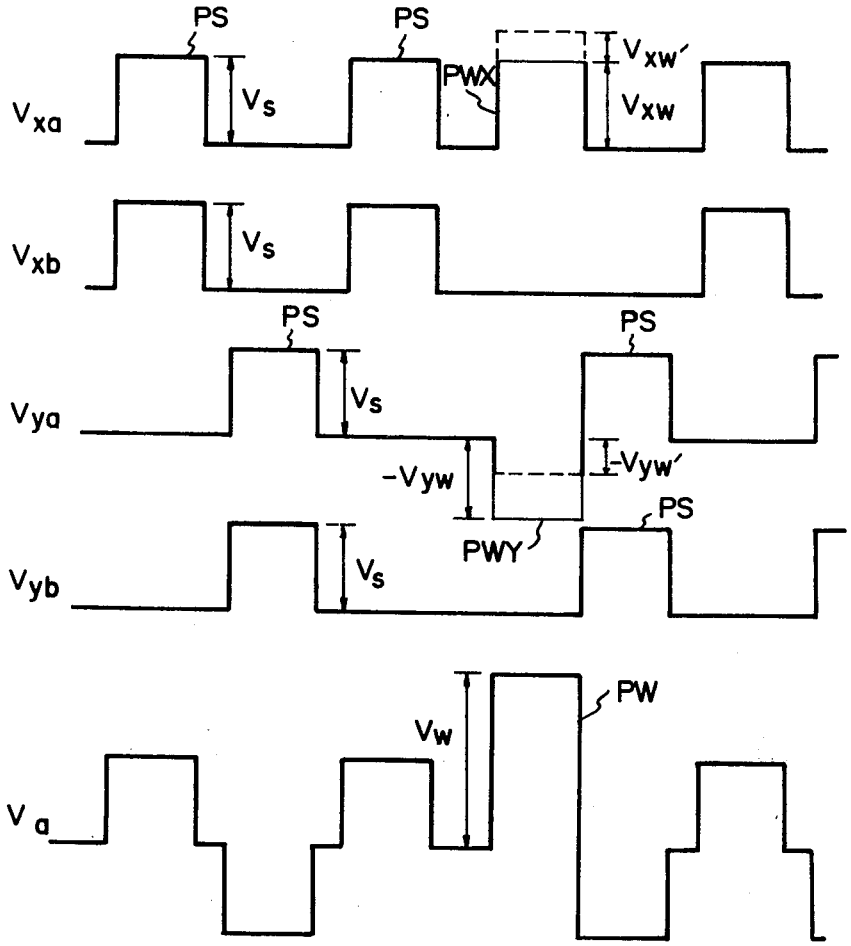
FIG. 8 is a waveform diagram showing driving waveforms employed in the embodiment of this invention.

FIG. 8 shows driving waveforms used in the embodiment of this invention. Reference characters $V_{xa}$ and $V_{ya}$ indicate pulse waveforms which are applied to selected ones of the X and Y electrodes, respectively; $V_{xb}$ and $V_{yb}$ designate pulse waveforms applied to unselected X and Y electrodes, respectively; $V_a$ identifies a pulse waveform applied to a selected discharge point; PS denotes a sustain pulse of a voltage $V_s$; PWX represents a positive half selection write pulse of a voltage $V_{xw}$; PWY shows a negative half selection write pulse of a voltage $V_{yw}$; and PW refers to a write pulse of a voltage $V_{xw} + V_{yw} = V_w$. Following the write pulse PW, the sustain pulse PS is applied to stabilize a discharge produced at the selected discharge point.

The voltage $V_{xw}$ of the half selection write pulse PWX can be made equal to the voltage $V_s$ of the sustain pulse PS. In such a case, the power source for producing the voltage $V_s = V_{xw}$ can also be used for the generation of the write pulse PWX and the sustain pulse PS.

Further, a voltage $V_{xw'}$ may also be superimposed on the sustain pulse PS to obtain the half selection write pulse PWX and, in this case, by this write pulse PWX and the half selection write pulse PWY, of the voltage $V_{yw}$, the write pulse PW of the voltage $V_s + V_{xw'} + V_{yw'} = V_w$ can be applied to the selected discharge point.

In short, it is sufficient only to apply pulses to selected ones of the X and Y electrodes so that the potential difference between the opposing electrodes forming the selected discharge point may provide a voltage high enough to produce a discharge. Accordingly, in this invention, the negative write pulse, which is applied to the electrodes of the larger pitch, does not imply that it is absolutely negative (as viewed from the ground potential) but implies that it has a polarity which is negative relative to the potential of the electrode of the smaller pitch.

As has been described in the foregoing, in the present invention, either one of the electrode pitches of the X and Y electrodes is selected to be smaller than the other so as to enable a high resolution display, and by applying a positive write pulse to the electrodes of the smaller electrode pitch and a negative write pulse to the electrodes of the larger electrode pitch, a composite write pulse is applied to a selected discharge point to perform the same normal operation as in the prior art panel. Accordingly, this invention has the advantage of ensuring that the gas discharge panel is capable of providing a stable, high resolution display.

It will be apparent that many modifications and variations may be effected without departing from the scope of novel concepts of this invention.

What is claimed is:

1. A drive system for driving a gas discharge panel, said panel comprising a plurality of X electrodes respectively covered with dielectric layers and forming an X-electrode group, and a plurality of Y electrodes respectively covered with dielectric layers and forming a Y-electrode group, which are disposed opposite to each other across a space having sealed therein a discharge gas, wherein a given one of the X electrode group and the Y electrode group has a pitch which is smaller than the pitch of the other electrode group; said drive system comprising:

first means for applying a positive pulse voltage to a selected one of the electrodes of said given one of said X and Y electrode groups; and second means for applying a negative pulse voltage to a selected one of the electrodes of the other one of the X and Y electrode groups;

whereby to impose a write pulse on a corresponding selected discharge point of said gas discharge panel.

2. The drive system according to claim 1, said drive system comprising means for applying sustain pulse voltages alternately to the selected electrodes of said given one and said other one of the electrode groups, respectively, following the application of the negative pulse voltages, respectively.

3. The drive system according to claim 2, wherein the magnitude of the positive pulse voltage applied to the selected one of the electrodes of the given one of the X and Y electrode groups is selected to be substantially equal to the level of the sustain voltage.

4. The drive system according to claim 1, wherein the electrodes of the given one of the X and Y electrode groups are the X electrodes disposed in a vertical direction.

5. The drive system according to claim 2, said drive system including means for superimposing the pulse voltage on the sustain pulse voltage applied to the selected one of the electrodes of the given one of the X and Y electrode groups.

6. The drive system according to claim 1, wherein said first means comprises a plurality of address switching transistors.

7. The drive system according to claim 6, wherein said first means further comprises a plurality of address clamping transistors.

8. The drive system according to claim 1, wherein said second means comprises a plurality of address switching transistors.

9. The drive system according to claim 8, wherein said second means further comprises a plurality of address clamping transistors.

10. The drive system according to claim 2, wherein said means for applying sustain pulse voltages comprises a plurality of up-sustain transistors and a plurality of down-sustain transistors.

* * * * *

UNITED STATES PATENT AND TRADEMARK OFFICE

CERTIFICATE OF CORRECTION

PATENT NO. : 4,107,578

DATED : August 15, 1978

INVENTOR(S) : Toyoshi Kawada et al

It is certified that error appears in the above-identified patent and that said Letters Patent are hereby corrected as shown below:

Column 1, line 39, "applid" should be --applied--.
Column 3, line 9, "supplid" should be --supplied--.
Column 4, line 20, "OYD1" should be --QYD1--.

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*